US005944600A

United States Patent [19]

Zimmermann

[11] Patent Number: 5,944,600

[45] Date of Patent: Aug. 31, 1999

[54] PROCESS FOR EMPTYING THE TRAY SPACE OF FLAT-RUNNING COIN-COUNTING AND COIN-SORTING MACHINES

[75] Inventor: Thomas Zimmermann, Berlin, Germany

[73] Assignee: F. Zimmermann GmbH & Co. KG, Berlin, Germany

[21] Appl. No.: 08/908,320

[22] Filed: Aug. 7, 1997

[30] Foreign Application Priority Data

Aug. 8, 1996 [DE] Germany ..... 196 33 503

[51] Int. Cl.[6] ..... G07D 3/00; G07D 1/00

[52] U.S. Cl. ..... 453/10; 453/49; 453/57; 221/265

[58] Field of Search ..... 453/3, 4, 6, 7, 453/10, 11, 12, 49, 57; 221/265

[56] References Cited

U.S. PATENT DOCUMENTS

| | | | |
|---|---|---|---|
| 1,236,519 | 9/1917 | White | 221/265 |
| 3,565,086 | 2/1971 | Zimmermann | 453/11 |
| 4,088,143 | 5/1978 | Bezsilko | 453/6 |
| 4,545,511 | 10/1985 | Lastinger | 222/367 |
| 5,064,404 | 11/1991 | Champion | 453/57 |
| 5,370,575 | 12/1994 | Geib et al. | 453/3 |

FOREIGN PATENT DOCUMENTS

| | | |
|---|---|---|
| 1 574 176 | 2/1974 | Germany . |
| 34 19 589 | 1/1986 | Germany . |

*Primary Examiner*—Christopher P. Ellis
*Assistant Examiner*—Bryan Jaketic
*Attorney, Agent, or Firm*—McGlew and Tuttle, P.C.

[57] ABSTRACT

A process for emptying the tray space of flat-running coin-counting and coin-sorting machines with a coin support with coin tray. The process includes the automatic emptying and simple cleaning of the tray space and the elimination of disturbances caused by, e.g., jamming in the area of the coin intake. This occurs without opening the coin transport device, the height limitation device or the like, and which guarantees a high level of safety against unauthorized access to the tray space. The coin support is opened in the downward direction.

12 Claims, 3 Drawing Sheets

PROCESS FOR EMPTYING THE TRAY SPACE OF FLAT-RUNNING COIN-COUNTING AND COIN-SORTING MACHINES

FIELD OF THE INVENTION

The present invention pertains to a process for emptying the tray space of flat-running coin-counting and coin-sorting machines with a coin support with coin tray.

BACKGROUND OF THE INVENTION

A coin sorting and counting machine is described in DE 1 574 176. The prior-art coin-sorting and -counting machines comprise essentially a rotatingly driven tray with a horizontal sorting channel, which has a fall-out opening and a counting means, with an arm, which is arranged in front of the entry opening of the sorting channel above the tray, is mounted on one side and is adjustable to the thickness of the coins to be counted, and with a coin transport means that can be adjusted to the thickness of the coins to be counted.

The device for sorting and counting coins of a group of coins according to DE 34 19 589 C1 contains a horizontal coin tray, with a horizontal guide path, which joins the horizontal coin tray essentially tangentially and is provided with an elastically mounted conveyor belt and with a vertical guide edge for the coins.

All the prior-art devices have a tray space arranged rigidly at the machine, into which the coins to be sorted and/or counted are introduced. Coins or objects can be taken out or contaminants can be removed only after stopping the machine, and, in the case of machines with closed, inaccessible tray space only after additionally removing the covers or the like and after swinging open the coin transport means.

SUMMARY AND OBJECTS OF THE INVENTION

The primary object of the present invention is to develop a process for emptying the tray space of flat-running coin-counting and coin-sorting machines, with which automatic emptying and simple cleaning of the tray space and the elimination of disturbances, e.g., those caused by jamming in the area of the coin intake, is possible without swinging open the coin transport means, the height limitation means, etc., and with which a high level of safety against unauthorized access to the tray space is guaranteed.

To accomplish this object, the present invention provides for the coin support being open in the downward direction. According to an advantageous embodiment, the bottom of the coin tray with the drive as a unit is swung obliquely downward, and the contents of the tray are removed to the outside via a slope. The complete opening of the tray space in the downward direction makes it possible to independently eliminate jamming in the area of the coin intake between the centrifugal tray and the removing conveyor belt. Foreign objects that may be present are removed and do not remain in the tray space during the subsequent counting and sorting processes. Contaminants of any kind also can not only be dislodged, but also removed.

In another preferred embodiment, the bottom of the coin tray with the drive as a unit is pivoted optionally to the left or to the right by up to 180° via the central axis of the bottom of the coin tray. The bottom of the coin tray rotates to the left or to the right in the process, and the foreign objects or contaminants adhering to it are moved away from the tray as a consequence of the centrifugal force or they fall off when the coin tray is stopped.

The present invention will be explained in greater detail below on the basis of exemplary embodiments of a device for emptying the tray space of a flat-running coin-counting and coin-sorting machine, which is shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
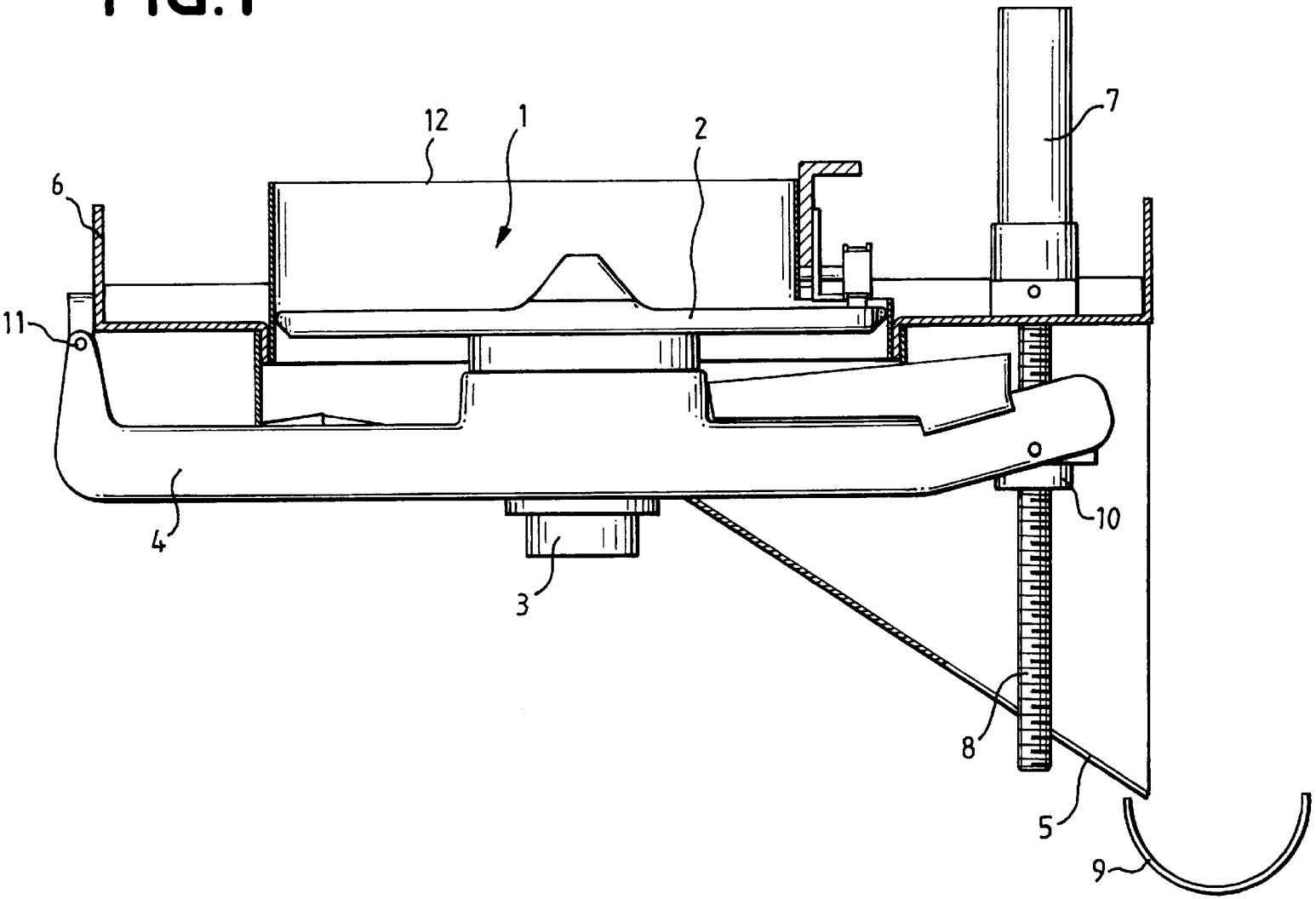
FIG. 1 is a schematic, partially cutaway side view of the coin support area in the working position.

Corresponding to the representation in FIG. 1, the coin support 1 comprises essentially a rotatingly driven coin tray 2 with a coin shaft 12 and its drive 3, and a tilting means 4 for the unit formed by the coin tray 2 and its drive 3. The coin support 1 is located in a housing, not shown, and is connected to a base plate 6, to which the tilting means 4 and the coin shaft 12 are also fastened.

The tilting means 4 comprises essentially a coin tray mount 11, e.g., a hinge, a lowering means, e.g., one comprising a threaded spindle 8 with a spindle nut 10 mounted in a joint.

A slope 5 (e.g., a chute) and a discharge chute 9 are in connection with the tilting means 4.

The coin support 1 may be located in, e.g., a self-service automated teller machine. The coin support 1 is accommodated in a closed system in this case, and the user of the automated teller machine has no possibility of accessing the tray space.

Coins, not shown, are introduced into the coin support 1 via a coin slot, not shown, e.g., for counting. After the start and completion of the counting process, the user of the automatic teller machine receives a receipt for the sum introduced, with which he can make purchases or with which he can obtain a credit on an account.

Figure 2:
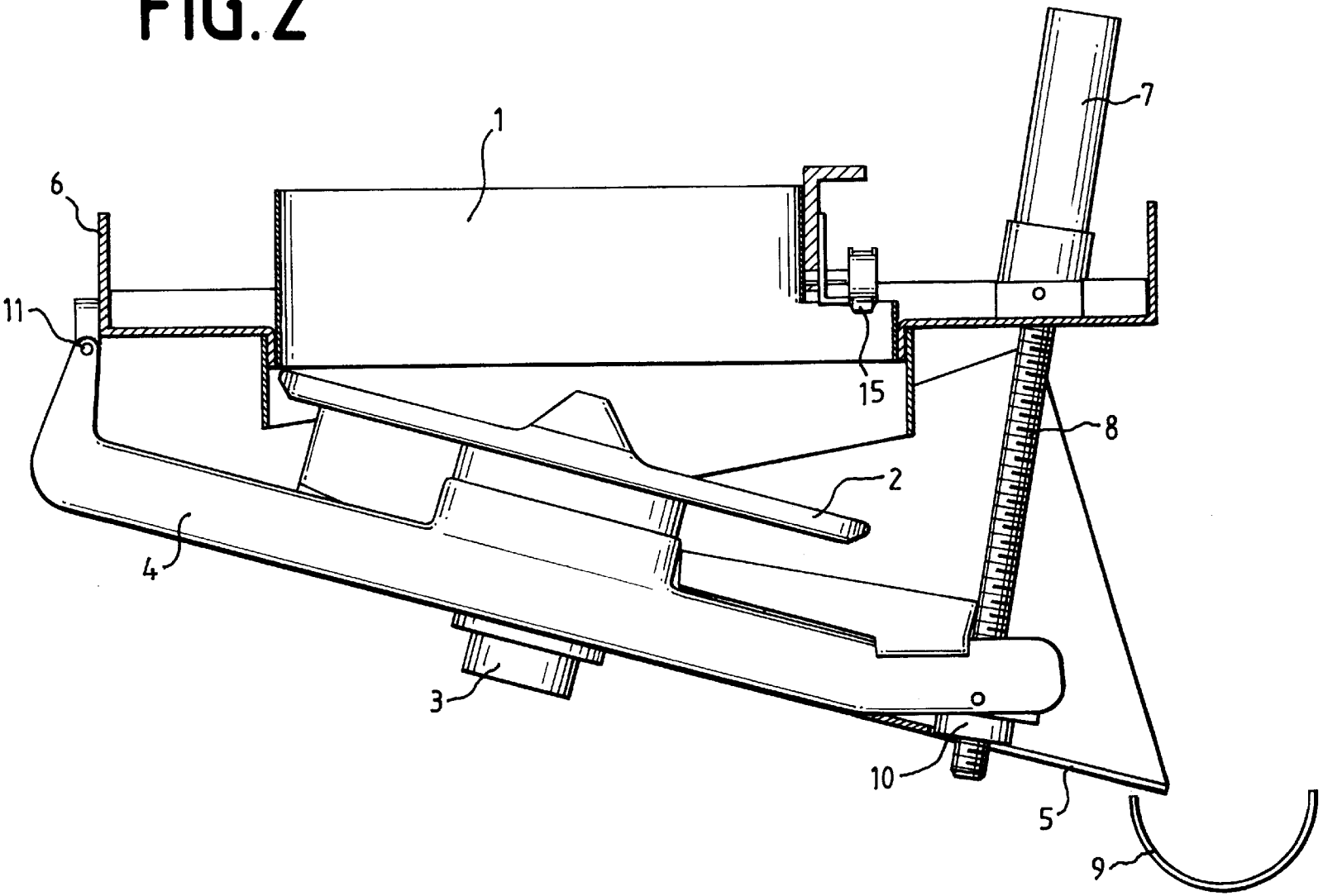
FIG. 2 is the schematic side view of the coin support area according to FIG. 1 in the emptying position.

After the end of such a service, an emptying and cleaning cycle is automatically started, which consists of the unit comprising the coin tray 2 and the drive 3 being tilted downward via the tilting means 4 according to the representation in FIG. 2 and of jams that may have occurred in the coin intake area 15 being eliminated, foreign objects being emptied and contaminants of any kind being spilled out via the slope 5 and the discharge chute 9.

Provisions may also be made for the customer of the automatic teller machine to be able to interrupt or terminate the counting process by pressing a button and for the contents introduced to be able to be removed via the discharge chute 9.

Corresponding to the representation in FIG. 2, the tilting means 4 is actuated via a drive 7, by means of which the coin tray 2 is lowered and then raised via the threaded spindle 8 and the spindle nut 10.

Instead of the threaded spindle 8 and the spindle nut 10, it is also possible to use other types of drive, e.g., hydraulic or pneumatic drives.

Figure 3:
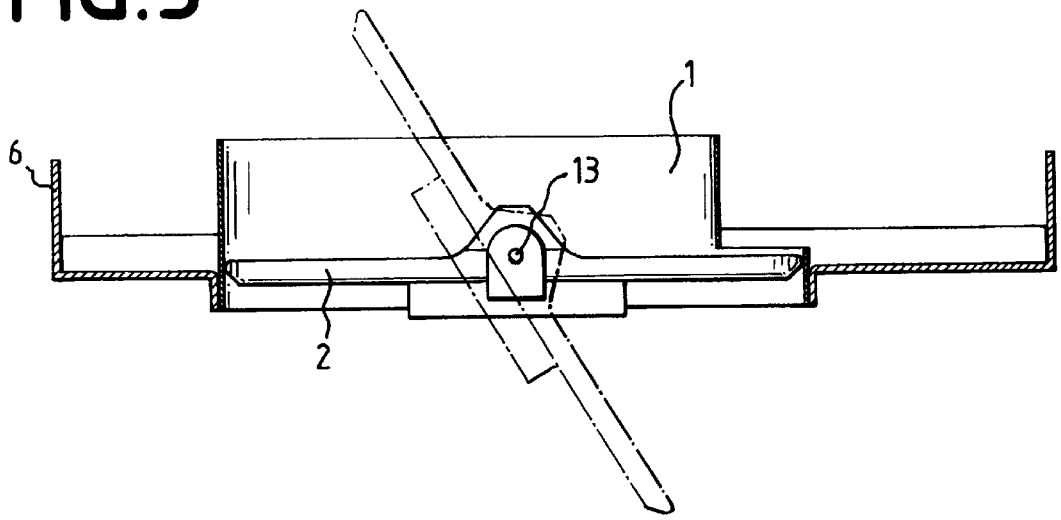
FIG. 3 is the schematic side view of a second embodiment of the coin support area.

Another embodiment of a tilting means for the coin tray 2 is shown in FIG. 3.

Corresponding to FIG. 3, the coin tray 2 is pivoted over its central axis 13 optionally to the left or to the right—to the right in the example according to FIG. 3—into an oblique position such that the contents of the tray will be spilled out. In the extreme case, the coin tray 2 is pivoted by 180°, so that the bottom of the coin tray points downward.

Figure 4:
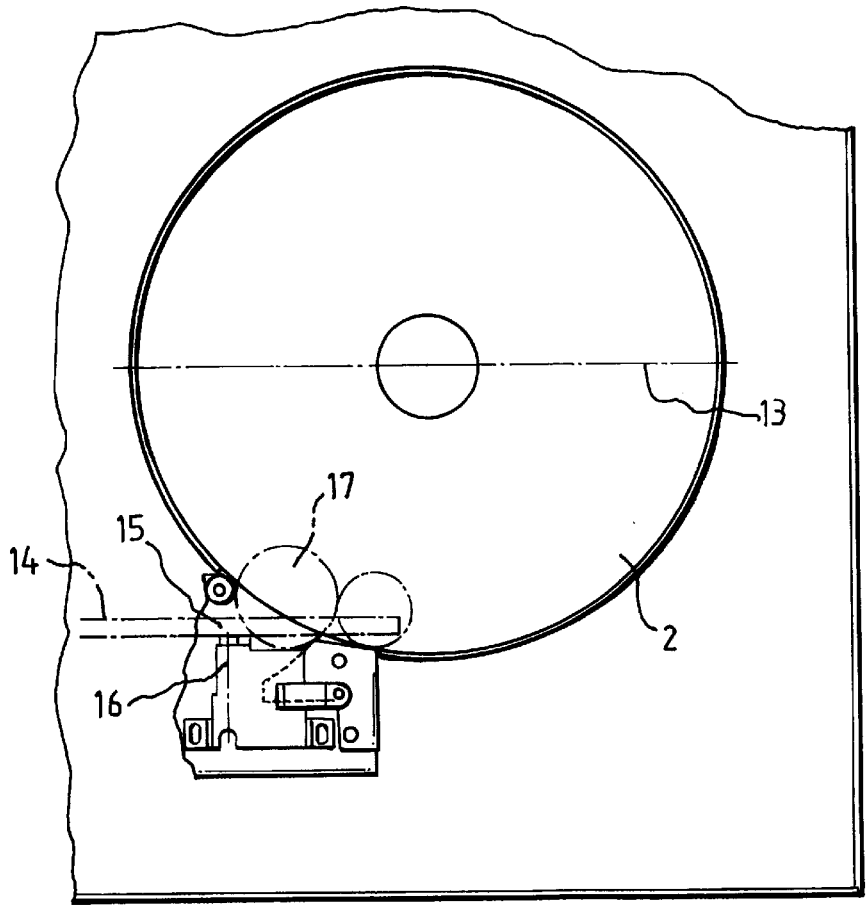
FIG. 4 is the schematic top view of the coin tray with the coin intake area.

Coins or foreign objects 17 that may have jammed in the coin intake area 15 or in the coin recognition area 16 are dislodged and removed after pivoting the coin tray 2 into a desired oblique position by the direction of transport of the coin transport means 14 being reversed (FIG. 4).

While specific embodiments of the invention have been shown and described in detail to illustrate the application of the principles of the invention, it will be understood that the invention may be embodied otherwise without departing from such principles.

What is claimed is:

1. A process for emptying the tray space of flat-running coin-counting and coin-sorting machines, comprising the steps of:

providing a coin support with a coin tray;

sorting coins with said coin tray, opening said coin support in a downward direction;

providing a chute adjacent said coin tray after said opening of said coin tray;

transporting contents of said coin tray from said coin tray to said chute after said opening of said coin tray.

2. The process in accordance with claim 1, further comprising providing a chute adjacent said coin tray after said opening of said coin tray;

transporting contents of said coin tray from said coin tray to said chute after said opening of said coin tray.

3. A process for emptying the tray space of flat-running coin-counting and coin-sorting machines, comprising the steps of:

providing a coin support with a coin tray, said coin tray having a central axis; and opening said coin support in a downward direction, including pivoting said coin tray about said central axis by up to 180° to one of a left and a right direction with respect to said central axis.

4. A process for emptying the tray space of flat-running coin-counting and coin-sorting machines, comprising the steps of:

providing a coin support with a coin tray; and opening said coin support in a downward direction;

providing said coin support with coin tray in a closed self-service automated teller system such that a tray space of said coin tray is inaccessible from the outside of said system, and said step of opening said coin support includes automatically swinging said coin tray obliquely downward after a step of counting and/or after a step of sorting and monitoring the steps and signaling irregularities such that a repeated misuse is ruled out.

5. A process for emptying the tray space of flat-running coin-counting and coin-sorting machines, comprising the steps of:

providing a coin support with a coin tray, said coin tray including a drive;

sorting coins with said coin tray;

opening said coin support in a downward direction, said step of opening said coin support including swinging said coin tray with said drive obliquely downward;

removing contents of the coin tray to the outside via a slope of said obliquely downward tray.

6. A process for emptying the tray space of flat-running coin-counting and coin-sorting machines, comprising the steps of:

providing a coin support with a coin tray, said coin tray having a central axis;

sorting coins with said coin tray;

opening said coin support in a downward direction, said step of opening said coin support including pivoting said coin tray about said central axis by up to 180° to one of a left and a right direction with respect to said central axis.

7. A process for emptying the tray space of flat-running coin-counting and coin-sorting machines, comprising the steps of:

providing a coin support with a coin tray, said coin tray including a drive;

sorting coins with said coin tray;

opening said coin support in a downward direction, said step of opening said coin support including swinging said coin tray with said drive automatically obliquely downward after a step of counting and/or said sorting of the coins in order to eliminate a possible jam and to remove contaminants and foreign objects from said coin tray via a downward slope of said coin support.

8. A process for emptying the tray space of flat-running coin-counting and coin-sorting machines, comprising the steps of:

providing a coin support with a coin tray;

sorting coins with said coin tray;

opening said coin support in a downward direction;

providing said coin support with coin tray in a closed self-service automated teller system such that a tray space of said coin tray is inaccessible from the outside of said system, and said step of opening said coin support includes automatically swinging said coin tray obliquely downward after a step of counting and/or after a step of sorting and monitoring the steps and signaling irregularities such that a repeated misuse is ruled out.

9. A process for emptying the tray space of flat-running coin-counting and coin-sorting machines, comprising the steps of:

providing a coin support with a coin tray;

sorting coins with said coin tray;

opening said coin support in a downward direction;

a direction of rotation of said coin tray is reversed after swinging out said coin tray to dislodge contaminants or the like.

10. The process in accordance with claim 9, wherein a cleaning means is activated after the swinging out of said coin tray.

11. A process for emptying the tray space of flat-running coin-counting and coin-sorting machines, comprising the steps of:

providing a coin support with a coin tray;

sorting coins with said coin tray;

opening said coin support in a downward direction;

removing contents of said coin tray via a downward slope of said coin support after said opening.

12. A process for emptying the tray space of flat-running coin-counting and coin-sorting machines, comprising the steps of:

providing a coin support with a coin tray;

sorting coins with said coin tray;

opening said coin support in a downward direction;

a coin shaft is arranged above said coin support, said opening of said coin support in said downward direction is with respect to said coin shaft;

removing contents of said coin tray via a downward slope of said coin support after said opening.

* * * * *